United States Patent [19]

Roysher

[11] Patent Number: 4,818,021

[45] Date of Patent: Apr. 4, 1989

[54] USER VARIABLE CHAIR

[76] Inventor: Martin Roysher, Box 255, Delmae, N.Y. 12054

[21] Appl. No.: 211,148

[22] Filed: Jun. 22, 1988

Related U.S. Application Data

[63] Continuation of Ser. No. 5,286, Jan. 16, 1987, abandoned, which is a continuation of Ser. No. 688,899, Jan. 4, 1985, abandoned.

[51] Int. Cl.[4] ..... A47C 3/00

[52] U.S. Cl. ..... 297/440; D 6/369; 297/284; 297/458; 297/460

[56] References Cited

U.S. PATENT DOCUMENTS

| | | | |
|---|---|---|---|
| 87,644 | 3/1869 | Daft | 297/460 |
| D. 133,847 | 9/1942 | Brodovitch | D 6/369 |
| D. 151,617 | 11/1948 | Feraud | D 6/369 |
| D. 168,501 | 12/1952 | Guillon | D 6/369 |
| D. 168,993 | 3/1953 | Gould | D 6/369 |
| 2,507,609 | 5/1950 | Miles | 297/391 X |
| 3,598,444 | 8/1971 | Seiter | 297/440 |
| 4,192,547 | 3/1980 | Geier | 297/458 |

FOREIGN PATENT DOCUMENTS

| | | | |
|---|---|---|---|
| 1382834 | 2/1975 | United Kingdom | 297/284 |

*Primary Examiner*—Peter A. Aschenbrenner
*Attorney, Agent, or Firm*—Finnegan, Henderson, Farabow, Garrett & Dunner

[57] ABSTRACT

A user-variable chair comprises a frame having two opposing sides and cord adjustably strung between the opposing sides to provide individualized support for the user of the chair, for example, by forming intersecting, curved-surface support members.

9 Claims, 5 Drawing Sheets

USER VARIABLE CHAIR

This application is a continuation of application Ser. No. 055,286, filed Jan. 16, 1987, which is a continuation of application Ser. No. 688,899, filed Jan. 4, 1985.

BACKGROUND OF THE INVENTION

The present invention relates to a chair and, more particularly, to a user-variable chair.

Most chairs cannot be adjusted to fit a particular user's body or desired sitting position. Instead, the seat bottom, seat back, and armrests are configured to accommodate a person of average size who has no need for nonstandard seating support. Thus, such chairs are optimal for ony a small portion of the population.

A user-variable chair permits adjustment of the chair components to make sitting more comfortable for the person using it. Certain user-variable chairs have rigid seat bottoms or seat backs that can be moved through a range of angles. These chairs often are of complex construction and are expensive to manufacture.

Most user-variable chairs provide adjustment of only the seat bottoms, seat backs, and/or headrests. Such chairs fail to allow adjustment of the actual seating surface within these adjustable chair components or adjustment of other chair components, for example, supports for the neck, lumbar region, or sides. In addition, most conventional user-variable chairs do not provide "asymmetric" support (i.e., different support for different sides of the body) for people who, due to personal preferences or physical disability, prefer a chair that provides such support.

A principal objective of the present invention is a user-variable chair providing support to conform to the desires and needs of the chair's user.

Another objective of the present invention is an inexpensive, user-variable chair having adjustable headrests and lower back supports.

A third objective of the present invention is a user-variable chair providing adjustable seat components, each seat component having an adjustable support surface to provide individualized support for the chair's user.

Additional objectives and advantages of the present invention will be set forth in part in the description that follows and in part will be obvious from that description or may be learned from practice of the invention.

SUMMARY OF THE INVENTION

The present invention achieves its objects with a chair frame through which cord is strung or to which cord is attached to form customized body support members, some of which are inclined at oblique angles.

To achieve the objects and in accordance with the purpose of the invention, as embodied and as described broadly herein, the user-variable chair of this invention comprises a frame having two opposing sides and adjustable means for support including at least one cord strung non-horizontally between the opposing sides to provide individualized support.

One embodiment of the user-variable chair of the present invention comprises a frame having two opposing sides including two vertical members rigidly connected together, each of the vertical members having a plurality of holes; a seat bottom including at least one cord adjustably strung between the opposing sides through selected ones of the holes; a seat back including at least one cord strung between the opposing sides through selected ones of the holes; a lower back support member including at least one cord adjustably strung between the opposing sides through selected ones of the holes to form at least two intersecting, curved-surface lower back support members; and a headrest support member including at least one cord adjustably strung between the opposing sides through selected ones of the holes to form at least two intersecting, curved-surface head support members.

Both the foregoing general description and the following detailed description are exemplary and explanatory only and do not restrict the invention as claimed. For example, many other embodiments of the frame are possible as are other body support members formed by the cord strung between the frame.

The accompanying drawings, which are incorporated in and constitute a part of this specification, illustrate several exemplary embodiments of the invention, and together with the description, serve to explain the principles of the invention.

DESCRIPTION OF THE PREFERRED EMBODIMENTS

Reference will now be made in detail to present, preferred embodiments of the invention, examples of which are illustrated in the accompanying drawings.

Figure 1:
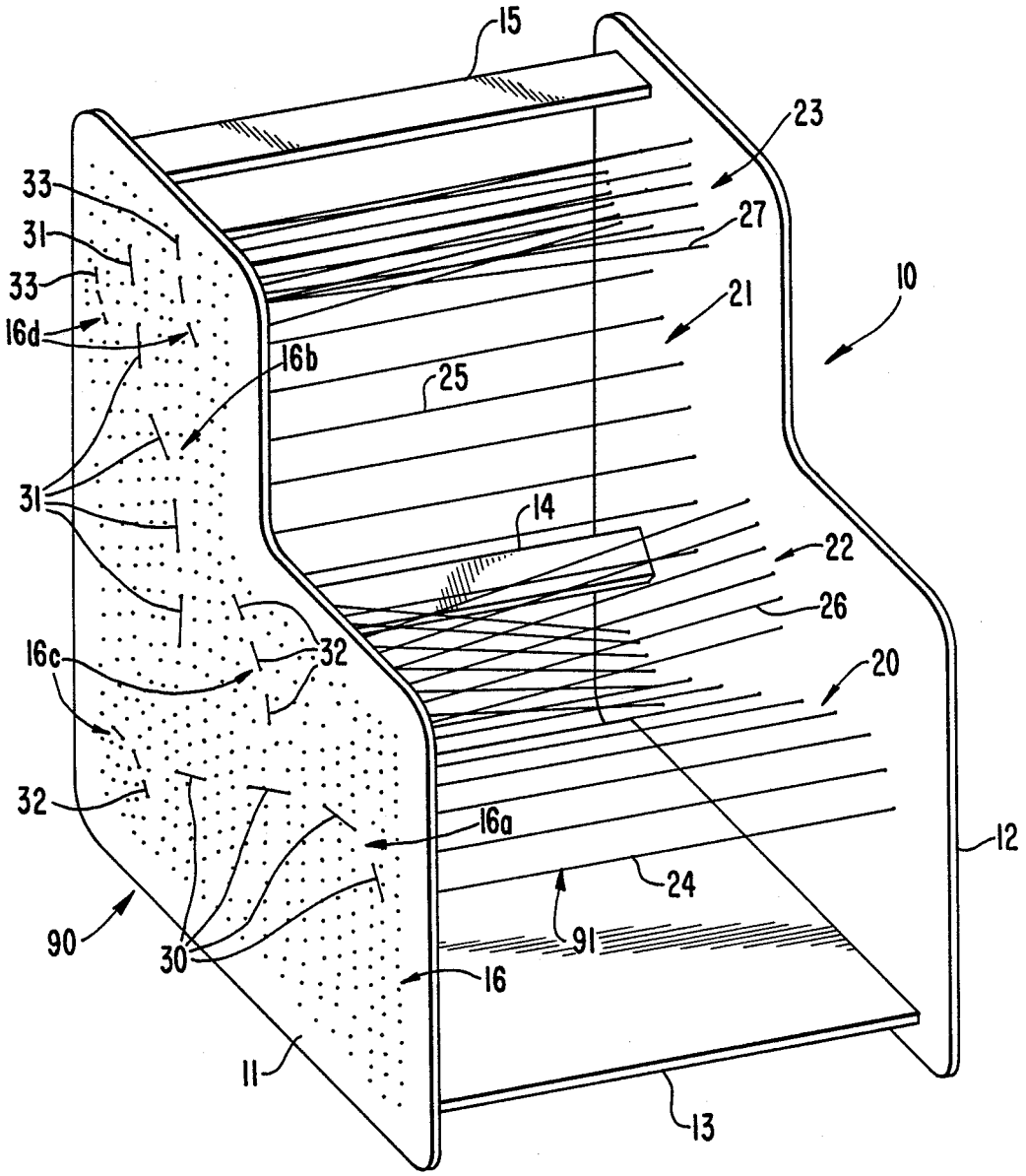
FIG. 1 is a perspective view of an example of a user-variable chair according to the present invention.

One embodiment of the user-variable chair of the present invention, designated generally by reference numeral 10 in FIG. 1, includes a frame 90 composed of two vertical planar opposing sides 11, 12 rigidly connected together by base plate 13, lower cross brace 14, upper cross brace 15, and two crossing diagonal braces (not shown) connecting and bracing the sides 11 and 12 at the backs of each side.

Each opposing side contains a plurality of holes. Holes 16 in side 11 are shown in FIG. 1. Side 12 contains a similar arrangement of holes, although the holes in side 12 are not shown for simplicity.

The arrangement of holes 16 shown in FIG. 1 is not the only arrangement that can be used in the chair 10. Holes 16 may be arranged in any pattern, for example a random pattern, as long as the pattern allows the user-variability of this invention. Preferably, sides 11, 12 include large numbers of holes to allow great flexibility in adjustment.

Figure 2:
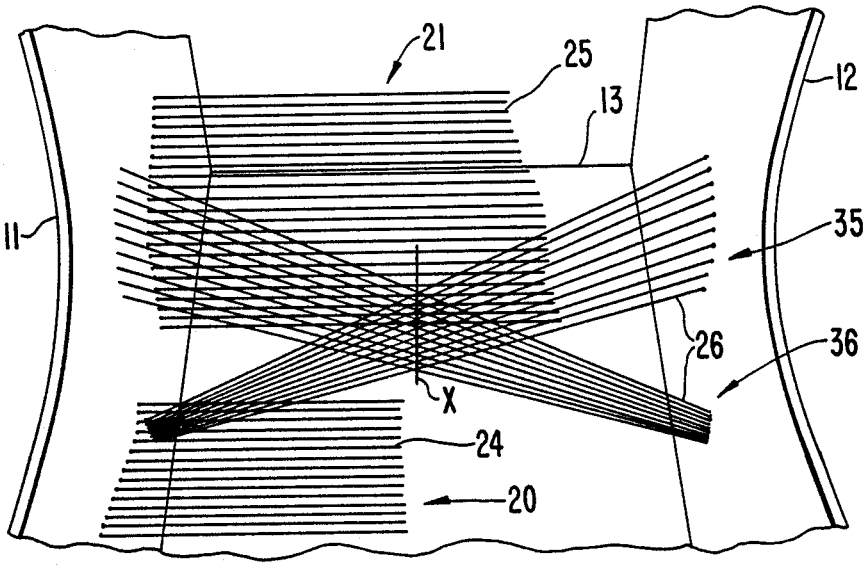
FIG. 2 shows the lower back support of the chair in FIG. 1.
Figure 3:
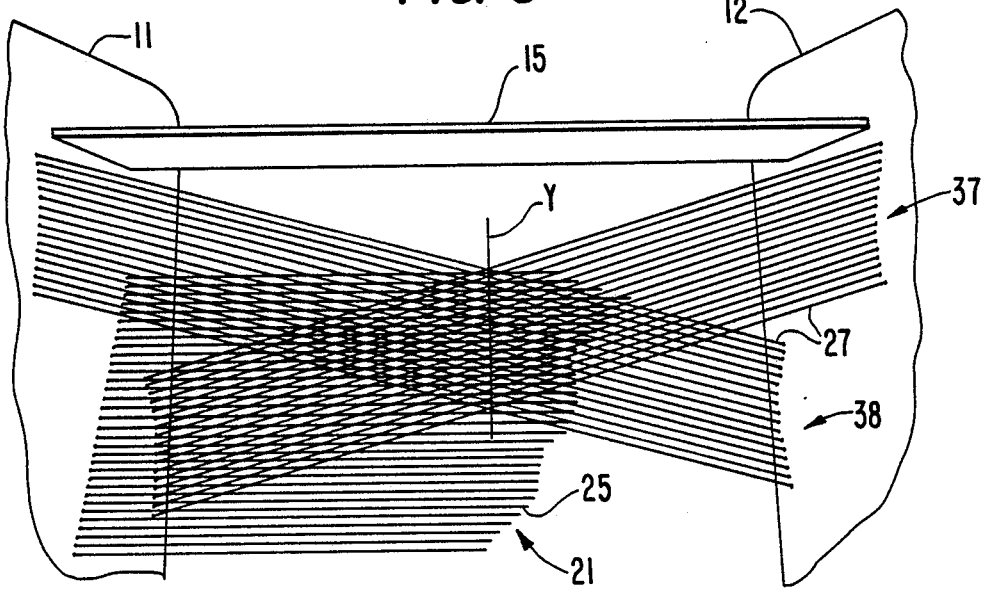
FIG. 3 shows the headrest of the chair in FIG. 1.

In the embodiment shown in FIGS. 1–3, sides 11, 12 and base plate 13 are constructed from a lightweight, rigid material, such as plywood or hard plastic. The material also should allow holes 16 to be formed easily, for example by drilling or molding. Cross braces 14 and 15 are rigidly connected to sides 11, 12 by, for example, screws or glue.

As will be explained below in greater detail, it is important that sides 11, 12 remain in a fixed relationship to each other when the user sits in the chair. Thus, the material forming sides 11, 12 and members 13–15 must be able to withstand the forces applied on them in use without substantial deformation.

In accordance with the present invention, the user-variable chair includes adjustable supporting means. In the embodiment of the user-variable chair 10 of this invention shown in FIG. 1, the adjustable supporting means includes cord 91 strung through selected ones of the holes 16 in opposing sides 11, 12. In chair 10, a separate length of cord 91 forms each of a seat bottom 20, a seat back 21, a lower back support 22, and a headrest 23.

The embodiment of the present invention shown in FIGS. 1–3 uses cords strung through holes in the frame to form seating surfaces. Alternative embodiments can use different methods of connecting the cord to the frame. FIG. 1a illustrates a method using cords strung through a separate stringing member 17, which is connected to the inside surfaces of sides 11, 12 by bolts **19*a* extending from stringing member 17 through slots 18 in sides 11, 12 and by wing nuts 19*b* tightened to the outside surfaces of sides 11, 12. In this alternative method, user variation is made easier because a given seating surface need not be restrung to be adjusted. Rather, the surface can be adjusted by loosening wing nuts 19*b*, sliding stringing member 17 along slots 18, retightening wing nuts 19*b*, and then taking up any slack or releasing any tension in the cords. With this method, each seating surface is, in effect, prestrung. Stringing member 17** can be formed of any rigid material, for example, metal or plastic.

FIGS. 1–3 show user-variable chair 10 with a seat bottom 20 formed by stringing cord segments 24 horizontally between opposing sides 11, 12 through selected holes **16*a*. Cord segments 24 need not be strung horizontally between opposing sides 11, 12 but can be strung to form a seat bottom 20 having, for example, a "V" shape from side to side or one side higher than the other. As seen in FIG. 1, cord portions 30, which are the portions of cord 91 lying on the outside of sides 11, 12 and anchoring seat bottom 20 to sides 11, 12, show one possible curvature for seat bottom 20. Seat bottom 20 can also, for example, be flat or "V"-shaped (channel-shaped) from front to back by proper selection of holes 16*a*. Similarly, by stringing cord segments 24 through different holes 16*a* in sides 11, 12, a user can vary the height as well as the length of seat bottom 20**. Thus, with the chair of this invention, a user has flexibility and discretion in forming a seat bottom providing maximum support and comfort for that user.

With continuing reference to the embodiment of this invention shown in FIGS. 1–3, seat back 21 is formed by stringing cord segments 25 horizontally and laterally between the opposing sides 11, 12 through selected holes **16*b*. As with cord segments 24, cord segments 25 can be strung non-perpendicularly between opposing sides 11, 12 to form a seat back 21 disposed at any angle with respect to sides 11, 12 desired by the user. By stringing cord segments 25 through different holes 16*b* in sides 11, 12, a user can vary the position and reclining angle of seat back 21 to maximize support and comfort. Cord segments 25 can also be strung to form a seat back 21 having any curvature desired by the user to provide maximum support and comfort, including a flat seat back. As seen in FIG. 1, cord portions 31, which are the portions of cord 91 lying on the outside of sides 11, 12 and anchoring seat back 21 to sides 11, 12, show one possible curvature for seat back 21. Seat back 21 can also have different shapes by stringing cord portions 31** at different angles.

FIGS. 1 and 2 show lower back or lumbar support 22, which is formed by stringing cord segments 26 non-horizontally between opposing sides 11, 12 through selected holes **16*c* to form two intersecting lower back support members 35, 36. Lower back support members 35, 36 each have curved surfaces defined by cord segments 26. In FIGS. 1 and 2, lower back support members 35, 36 intersect at X behind seat back 21, as shown in FIG. 2. This arrangement supports the user's lower back with three support members: seat back 21, lower back support member 35, and lower back support member 36. Lower back support members 35, 36 provide adjustable lateral support for the user's lower back. The curvature of lower back support members 35, 36 shown in FIGS. 1 and 2 is convex with respect to the user, as shown by cord portions 32 in FIG. 1**.

This invention, however, is not limited to a lower back support having only two support members. The user can string cord segments 26 to form more than two support members, or to form a single support member. Similarly, the lower back support members need not be strung symmetrically. The user can choose to string cord segments 26 through holes **16*c*** so that the resulting support members are asymmetric and provide different types and degrees of support for each side of the lower back.

A user selects holes for stringing cord segments 26 to form lower back support members 35, 36 having the desired curvature and placement. Variations can be also introduced for those support members, for example, by stringing several cord segments 26 through one hole on side 11 and different holes on side 12. The support members can have no curvature, that is, they can be planar support members, or can form a variety of other surfaces to suit the user. As shown in FIGS. 1 and 2, for example, cord segments 26 are more closely spaced at their lower attachments to sides 11, 12 than at their upper attachments, so that the curvature of lower back support members 35, 36 varies from one side of the chair to the other side.

FIGS. 1 and 3 show headrest 23 for chair 10, which is formed by stringing cord segments 27 non-horizontally through selected holes **16*d* in sides 11, 12 to form two intersecting head support members 37, 38. Head support members 37, 38 have curved surfaces defined by cord segments 27. Similar to holes 16*a–c*, holes 16*d* selected for stringing cord segments 27 can be chosen to form head support members 37 and 38 of any curvature or position desired by the user. As shown by cord portions 33 in FIG. 1, the curvature of head support members 37, 38 is concave with respect to the user. Cord segments 27 also can be strung to produce head support members 37, 38** having varying curvature from side to side.

In FIGS. 1 and 3, head support members 37, 38 intersect behind seat back 21, as shown in FIG. 3, so that the user's head is supported by both support members, and could also be supported by seat back 22, if the user so desired and adjusted the curvature and elevation at the top of seat back 22. Head support members 37, 38 provide adjustable lateral support for the user's head. As with lower back support 22, headrest 23 can be formed by stringing cord segments 27 to form more than two head support members or to form a single head support member in order to provide support and comfort which is optimal for the particular user. Different head support members can be strung to provide different support for the head and neck. Also, the support members need not be strung symmetrically. Thus, the user can select holes to provide support for the head and neck positioned on either side of the center of the chair.

The chair of the present invention can be strung by a number of methods. As described above, each support member in FIGS. 1–3 is strung with a separate length of cord. Alternatively, cord 91 can be a single, continuous length of cord, so that cord segments 24–27 are all part of a single piece of cord. Also, each cord segment 24–27 can be a separate piece of cord whose ends attach to sides 11 and 12.

The material for cord 91 must be strong enough to support the user's weight without stretching excessively or breaking. If the cord stretches excessively, the shape of the support members will deform to the point that the desired customized support is lost. If the cord is strung through many closely spaced holes to form a large number of cord segments, the cord material need not be as strong as if only a few cord segments are formed. The material for the cord must also be sufficiently flexible so that the user can string the cord through the holes and be comfortable when sitting on the support members formed from the cord. Examples of acceptable cord materials are synthetic or natural fibers such as nylon, sisal, hemp, and cotton or wool yarn. If strong cord material and widely spaced holes are chosen, comfort can be enhanced by laying a flexible cover or pad over the cord segments.

The frame of the claimed invention can have a number of alternative embodiments that might be structurally, economically, or aesthetically preferable to the embodiment 10 shown in FIGS. 1–3. One alternative embodiment of the claimed invention is shown by a side elevational view in FIG. 4 and a partial front view in FIG. 5. For simplicity, FIG. 5 shows only a few of the cord segments that combine to form the various support members.

Figure 4:
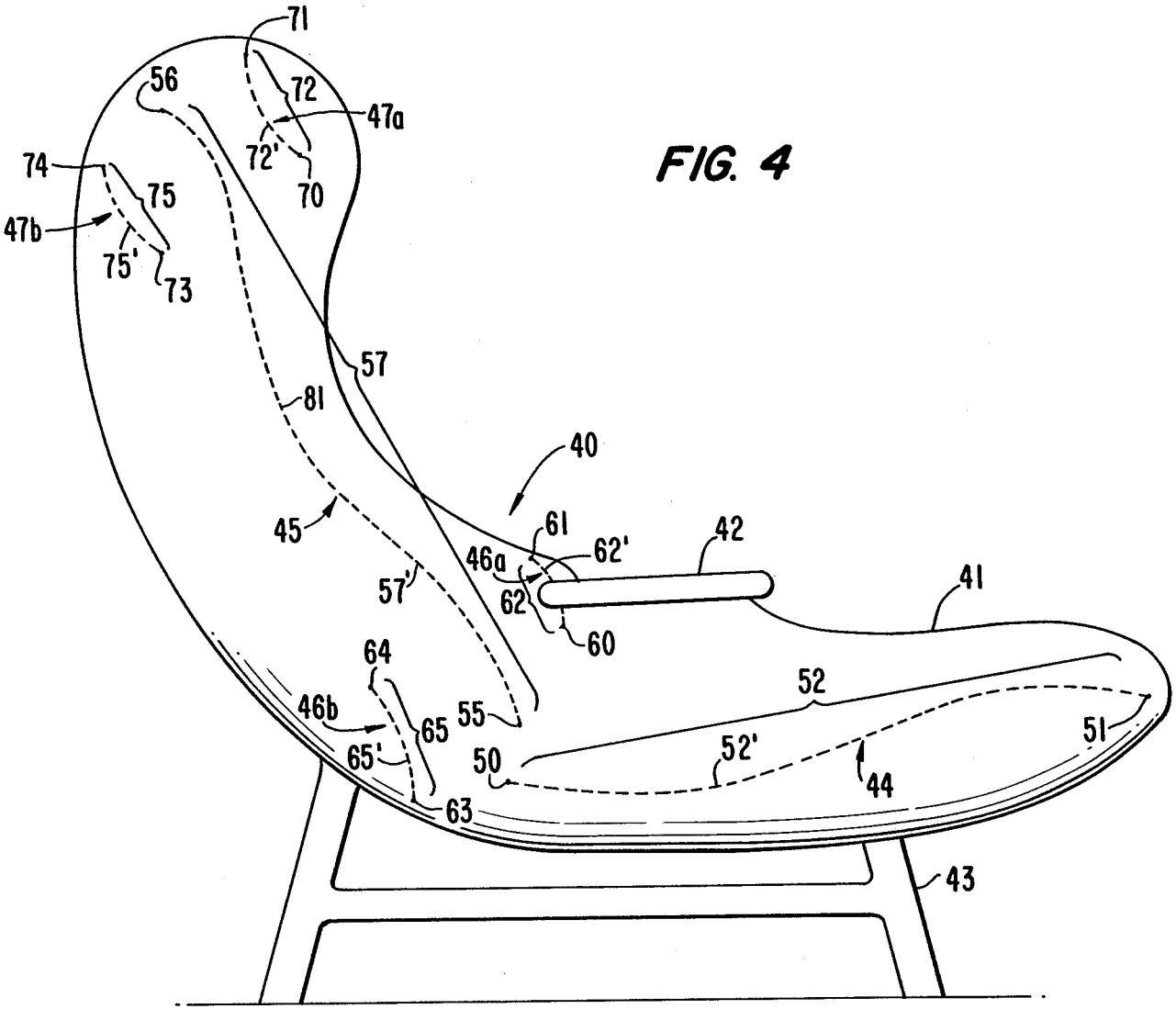
FIG. 4 is a side elevation of an alternative embodiment of a user-variable chair of this invention.
Figure 5:
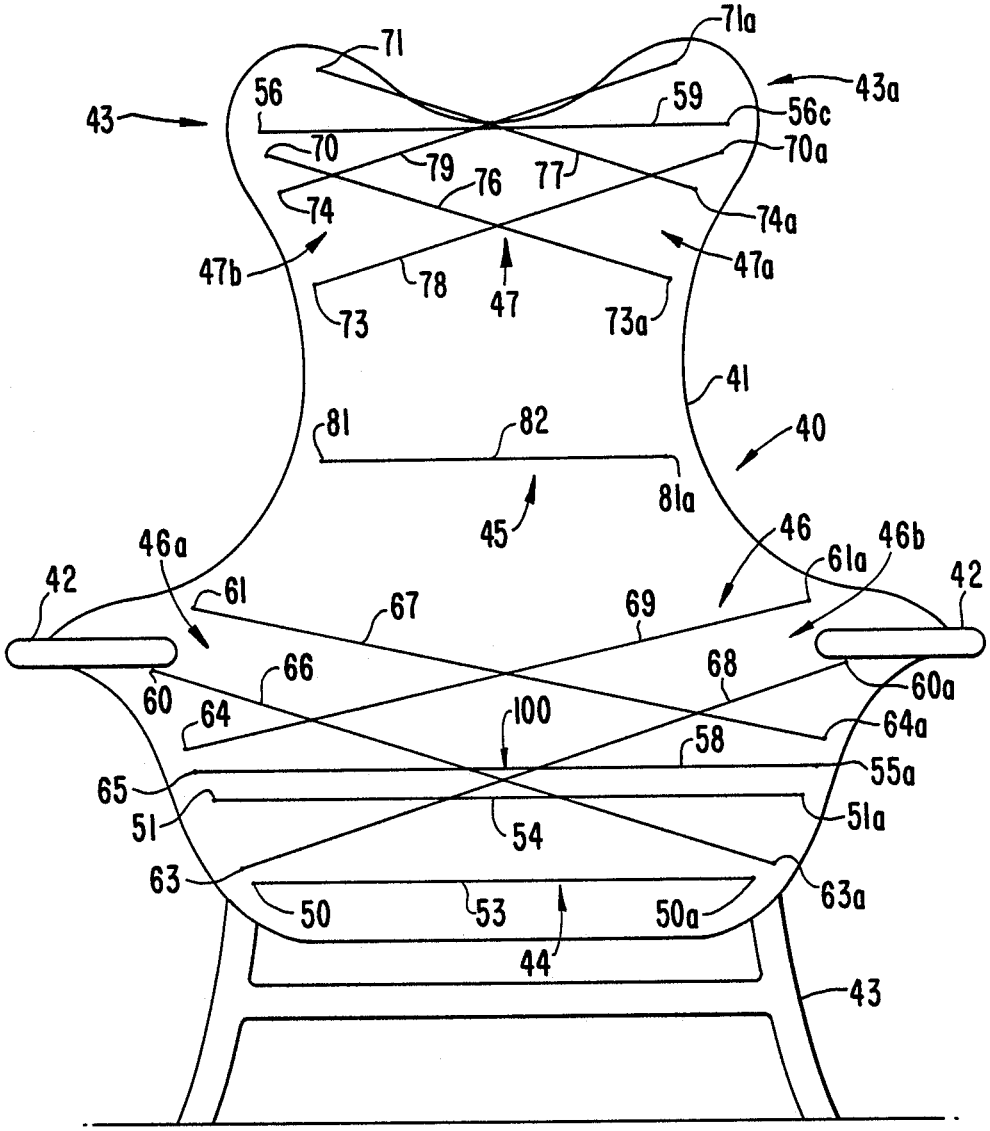
FIG. 5 is a partial front elevation of the chair in FIG. 4.

The user-variable chair of this invention in FIGS. 4 and 5 is designated generally by numeral 40 and is formed from a fiberglass or other polystyrene shell 41 that is connected to and supported by base support 43. Shell 41 also contains armrests 42 and can have steel, aluminum, or other reinforcement members to add strength to various parts of the chair 40. Shell 41 has two opposing sides 43, **43*a* each of which contains a plurality of holes, corresponding to holes 16 in FIG. 1, through which cord 100 is adjustably strung to form individualized support members. For clarity, only a few selected holes are shown in FIGS. 4 and 5. Sides 43, 43*a*, however, contain a sufficient number of holes to provide adequate adjustability of the positions and shapes of the support member of chair 40**.

Seat bottom 44 is formed by stringing cord 100 through selected holes in opposite sides 43, **43*a* of shell 41. FIG. 5 shows two seat bottom cord segments 53 and 54. Cord segment 53 is strung between holes 50 and 50*a* and forms the rearmost cord segment of the seat bottom of the embodiment shown in FIGS. 4 and 5. Cord element 54 is strung between holes 51 and 51*a* and forms the forwardmost cord segment of the seat bottom in this embodiment of the invention. The entire seat bottom 44 is formed by stringing cord horizontally between the opposite sides 43 and 43*a* of shell 41 through selected holes in those sides to form a curved seat bottom shown by curved line 52 in FIG. 4. Curved line 52 includes cord portions 52', which are portions of cord 100 lying on the outside of shell 41 and which anchor seat bottom 44 to shell 41**.

As shown in FIGS. 4 and 5, seat back 45 is formed by stringing cord 100 through selected holes in opposite sides 43, **43*a* of shell 41. FIG. 5 shows three seat back cord segments, 58, 59, and 82. Cord segment 58 is strung between holes 55 and 55*a* and forms the lowermost cord segment of seat back 45 in chair 40. Cord segment 59, strung between holes 56 and 56*a*, forms the uppermost cord segment of the seat back 45, and cord segment 82, strung between holes 81 and 81*a*, is an intermediate cord segment of seat back 45. The entire seat back 45 is formed by stringing cord between opposite sides 43 and 43*a* of shell 41 through selected holes in those sides to form a seat back whose cross section is defined by curved line 57 in FIG. 4. Curved line 57 includes cord portions 57', the portions of cord 100 lying on the outside of shell 41, and anchoring seat back 45 to shell 41**.

Lower back support 46 of chair 40 is formed by stringing cord 100 non-horizontally through selected holes in opposite sides 43, **43*a* of shell 41 to form two intersecting lower back support members 46*a*, 46*b*. First lower back support member 46*a* is shown partially in FIG. 5. Uppermost cord segment 67 of lower back support member 46*a* is formed by stringing cord 100 between holes 61 and 64*a*. Lowermost cord segment 66 of lower back support member 46*a* is formed by stringing cord 100 between holes 60 and 63*a*. Cord segment 69, strung between holes 64 and 61*a*, and cord segment 68, strung between holes 63 and 60*a*, form the uppermost and lowermost cord segments, respectively, of second lower back support member 46*b*. The holes in each side for stringing lower back support 46 are selected to form any desired curve, such as those shown by curved lines 62 and 65 in FIG. 4. Curved line 62 is made up of cord portions 62', which are the portions of cord 100 lying on the outside of shell 41 and anchoring lower back support member 46a to shell 41. Similarly, curved line 65 is made up of cord portions 65', which anchor lower back support member 46*b* to shell 41**.

Headrest 47 in chair 40 is formed by stringing cord 100 non-horizontally through selected holes in opposite sides 43, **43*a* of shell 41 to form two intersecting head support members 47*a*, 47*b*. First head support member 47*a* is shown partially in FIG. 5. Uppermost cord segment 77 of head support member 47*a* is formed by stringing cord 100 between holes 71 and 74*a*. Lowermost cord segment 76 of head support member 47*a* is formed by stringing cord 100 between holes 70 and 73*a*. Cord segment 79, strung between holes 74 and 71*a*, the cord segment 78, strung between holes 73 and 70*a*, form the uppermost and lowermost cord segments, respectively, of second head support member 47*b*. The holes selected for stringing headrest 47 can form any desired curve, such as those shown by curved lines 72 and 75 in FIG. 4. Curved line 72 is made up of cord portions 72', the portions of cord 100 lying on the outside of shell 41 and anchoring head support member 47*a* to a shell 41. Similarly, curved line 75 is made up of cord portions 75', which anchor head support member 47*b* to shell 41**.

As with the embodiment of the invention shown in FIGS. 1–3, the alternative embodiment shown in FIGS. 4 and 5 can be strung by a number of methods, such as by using a single length of cord 100 or by using a separate piece of cord for each support member or for each cord segment. also, angled seat backs and seat bottoms and asymmetric headrests and lower back supports can be strung. In addition, the user-variable chair embodied in FIGS. 4 and 5 can have a conventional seat back and seat bottom, either molded into shell 41 or supplied, for example, by foam rubber cushions. The conventional seat back and bottom are used in combination with a headrest, a lower back support, and any other desired supplementary support formed by stringing cord 100 through selected holes in sides 43 and 43*a* of shell 41.

Figure 6:
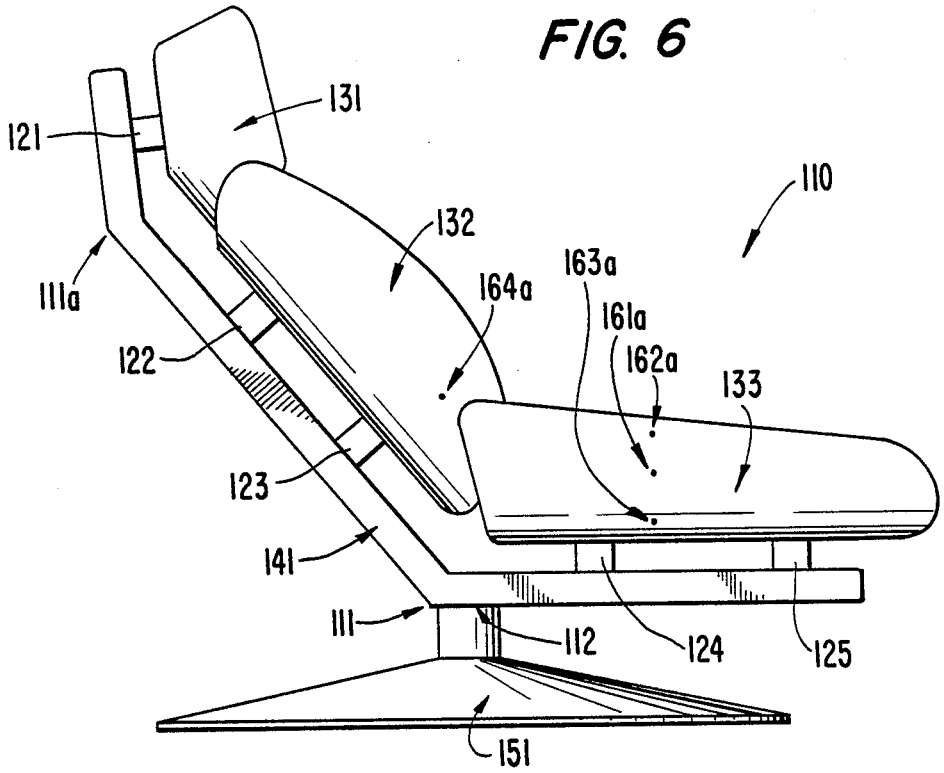
FIG. 6 is a side elevation of a third embodiment of the user-variable chair of this invention.
Figure 7:
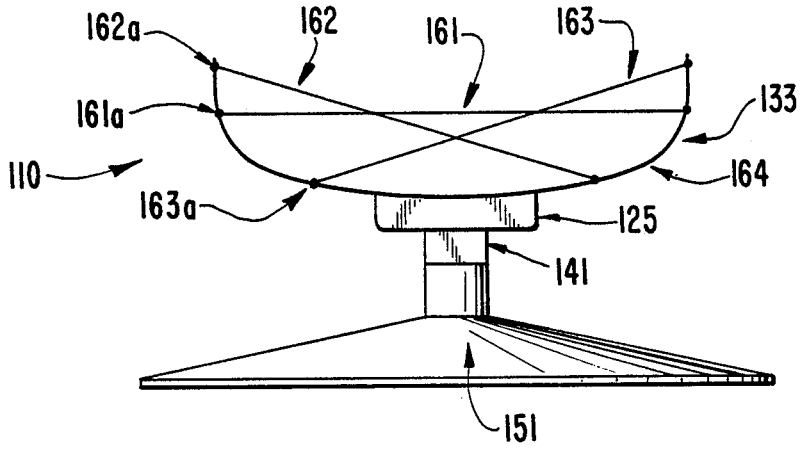
FIG. 7 is a partial front elevation of the chair in FIG. 6.

A third alternative embodiment, chair 110 illustrated in FIGS. 6 and 7, has a frame separated into segments corresponding, for instance, to a headrest 131, seat back 132, and seat bottom 133. These frame segments are affixed to a frame support member 141, which is attached to a base 151 and made of, for example, steel. The alignment of the frame segments can be changed by having adjustable connections between the frame support member 141 and base 151 at location 112, at frame support member points 111 and 111*a*, and at the points 121–125, where the frame segments attach to the frame member. Such adjustments are known in the art, but the actual seating surfaces within the adjustable components are not adjustable in conventional chairs.

The seating surfaces of the user-variable chair of this invention are adjustable themselves and with respect to one another. The frame segments 131, 132, and 133 are concave upward in cross section, as indicated in FIG. 7 which shows a front end view of base 151, frame support member 141, and bottom seat 133. Thus, each frame segment has opposing sides between which cord can be strung. Support members can be strung across these concave segments in the manner shown, for example, by cord segments 161, 162, and 163 strung through holes 161*a*, 162*a*, and 163*a* on FIGS. 6 and 7. Frame segments can be formed of stream-bent wood, molded fiberglass, or other plastic material reinforced with steel or other materials in such manner and at such locations as required for additional strength.

FIGS. 6 and 7 demonstrate the applicability of the basic concept of the user-variable chair of this invention to one of a variety of frame modifications and variations.

It will be apparent to those skilled in the art that further modifications and variations can be made in the user-variable chair of this invention. For example, the chair can include support members other than those described above, such as specialized orthopedic supports. The invention in its broader aspects is, therefore, not limited to the specific details and illustrative examples shown and described. Accordingly, departure may be made from such details without departing from the spirit or the scope of the general inventive concept.

What is claimed is:

1. A user-variable chair comprising:

at least one cord;

a frame having at least two sides each including an array of apertures through which said at least one cord is selectively strung to form a plurality of cord segments each defined by a different portion of said at least one cord strung between two apertures in different ones of said sides; and a plurality of support portions, each composed of a different group of said cord segments and each having the general shape of a surface passing through the cord segments in the corresponding group, the shape of each of said support portions being variably adjusted by alteration of the apertures through which said at least one cord is strung, said support portions including a seat support portion, a back support portion, and a supplemental support portion arranged on said frame such that the shape of said supplemental support portion is not parallel to the shapes of the seat and back portions, said support portion including two subportions, each composed of a different group of said cord segments and each having the general shape of a surface passing through the cord segments composing that subportion, wherein said subportions are arranged in said frame such that the surfaces passing through the cord segments composing said subportions intersect.

2. The chair of claim 1 wherein the shapes said supplemental support portion does not lie in a single plane and has curved contours.

3. The chair of claim 1 further comprising a second supplemental support portion having a shape which is not parallel to either said seat portion, said back portion, said sides, or said supplemental support portion, said second supplemental support portion being composed of a plurality of cord segments selectively strung between said sides and attached to a fourth selected group of said cord attachment means, said fourth selected group of cord attachment means being different from said first, second, and third selected groups.

4. The chair of claim 3 wherein the shapes said supplemental support portion and said second supplemental support portion intersect each other.

5. The chair of claims 1, 2 or 4 wherein said frame is made of molded fiberglass.

6. The chair of claims 1, 3 or 4 wherein said sides are planar and opposing, and wherein said array of apertures are formed in the opposing sides.

7. The user-variable chair of claim 1 wherein the surface passing the shape through the cord segments composing said subportions are substantially planar.

8. A user-variable chair comprising:

at least one cord;

a frame having at least two sides each including an array of apertures through which said at least one cord is selectively strung to form a plurality of cord segments each defined by a different portion of said at least one cord strung between two apertures in different ones of said sides; and a plurality of support portions, each composed of a different group of said cord segments and each having the general shape of a surface passing through the cord segments in the corresponding group, the shape of each of said support portions being variably adjusted by alteration of the apertures through which said at least one cord is strung, said support portions including a seat support portion, a back support portion, and a pair of lower back support portions arranged on said frame such that the shapes of said lower back support portions are not parallel to the shapes of the seat and back portions and such that the shape of said lower back support portions intersect each other.

9. The chair of claim 8 further comprising a headrest having at least two intersecting head support portions arranged on said frame such that the shapes of said headrest support portions intersect, said headrest support portions extending over at least part of said lower back support portions and being composed of a plurality of cord segments selectively strung between said sides.

* * * * *